US008302880B2

(12) United States Patent
Clarke

(10) Patent No.: US 8,302,880 B2
(45) Date of Patent: Nov. 6, 2012

(54) MONODISPERSE DROPLET GENERATION

(75) Inventor: Andrew Clarke, Haslingfield (GB)

(73) Assignee: Eastman Kodak Company, Rochester, NY (US)

( * ) Notice: Subject to any disclaimer, the term of this patent is extended or adjusted under 35 U.S.C. 154(b) by 378 days.

(21) Appl. No.: 12/664,941

(22) PCT Filed: Jun. 27, 2008

(86) PCT No.: PCT/GB2008/002217

§ 371 (c)(1),
(2), (4) Date: Dec. 16, 2009

(87) PCT Pub. No.: WO2009/004314

PCT Pub. Date: Jan. 8, 2009

(65) Prior Publication Data

US 2010/0170957 A1 Jul. 8, 2010

(30) Foreign Application Priority Data

Jul. 3, 2007 (GB) ..... 0712863.0

(51) Int. Cl.
*B05B 17/04* (2006.01)

(52) U.S. Cl. ..... 239/11; 239/3; 239/4; 239/102.2; 239/423; 239/690

(58) Field of Classification Search ..... 239/3, 4, 239/102.1, 202.2, 423, 424, 589, 690, 11; 424/93.7; 366/167.1, 341
See application file for complete search history.

(56) References Cited

U.S. PATENT DOCUMENTS

| | | | | |
|---|---|---|---|---|
| 5,813,614 | A * | 9/1998 | Coffee | 239/690 |
| 5,873,523 | A * | 2/1999 | Gomez et al. | 239/3 |
| 6,377,387 | B1 | 4/2002 | Duthaler et al. | |
| 2005/0172476 | A1 | 8/2005 | Stone et al. | |
| 2006/0163385 | A1 * | 7/2006 | Link et al. | 239/424 |
| 2006/0234051 | A1 | 10/2006 | Zhang et al. | |
| 2007/0003442 | A1 | 1/2007 | Link et al. | |
| 2007/0054119 | A1 | 3/2007 | Garstecki et al. | |
| 2007/0242560 | A1 * | 10/2007 | Norikane et al. | 366/167.1 |

FOREIGN PATENT DOCUMENTS

WO WO 99/31019 6/1999

(Continued)

OTHER PUBLICATIONS

Shelley L. Anna and Hans C. Mayer, *Physics of Fluids*, vol. 18, 121512 (2006).

(Continued)

*Primary Examiner* — Steven J Ganey
(74) *Attorney, Agent, or Firm* — William R. Zimmerli

(57) ABSTRACT

A method of creating substantially monodisperse droplets comprising supplying a first fluid (1) and a second immiscible fluid (2) within a set of channels, the second fluid surrounding the first fluid and filling the channels to form a composite jet. The composite jet passes through an entrance channel (4) into a wider cavity (3), where the first fluid breaks into droplets (5), the resulting composite of droplets of the first fluid within the second fluid passing through an exit channel (6). The cross sectional area of the exit channel perpendicular to the flow is smaller than the cross sectional area of the cavity and the passage of a droplet of the first fluid out of the cavity via the exit perturbs the composite flow field within the cavity such that the incoming jet of the first fluid is perturbed.

18 Claims, 14 Drawing Sheets

FOREIGN PATENT DOCUMENTS

| | | |
|---|---|---|
| WO | WO 02/23163 | 3/2002 |
| WO | WO 2004/002627 | 1/2004 |
| WO | WO 2005/103106 | 11/2005 |
| WO | WO 2006/096571 | 9/2006 |

OTHER PUBLICATIONS

George J. Hirasaki, *J. Adhesion Sci. Technol.*, vol. 7, No. 3, pp. 285-322 (1993).

* cited by examiner

MONODISPERSE DROPLET GENERATION

FIELD OF THE INVENTION

This invention relates generally to multi phase jet flow and microfluidics, more specifically to microfluidics arranged to control the generation of droplets of a dispersed phase within another, immiscible, phase and their size distribution. In particular the invention relates to the generation of fluid droplets on a micro scale and in a multi phase system.

BACKGROUND OF THE INVENTION

The manipulation of fluids to form fluid streams of a desired configuration, discontinuous fluid streams, particles, dispersions, emulsions, etc., for the purposes of fluid delivery, analysis and product manufacture, such as photographic silver halide emulsions and dispersions, is a relatively well studied art. Most of this prior work to create emulsions and dispersions results in relatively polydisperse size distributions. Recently highly monodisperse gas bubbles have been produced using a technique referred to as capillary flow focussing. In this technique, gas is forced out of a capillary tube into a bath of liquid, the tube positioned above a small orifice, and the contraction flow of the external liquid through this orifice focuses the gas into a thin jet which subsequently breaks into equal sized bubbles through a capillary instability. More recently US 2005/0172476 and US 2006/0163385 have disclosed flow focussing devices that allow monodisperse liquid in liquid droplets to be formed.

Microfluidics is an area of technology involving the control of fluid at a very small scale. Microfluidic devices typically include very small channels within which fluid flows. The channels can be branched or otherwise arranged to allow fluids to be combined with each other, to divert fluids to different locations, to cause laminar flow between fluids, to dilute fluids, and the like. The implication of small channels is generally that the Reynolds number $$\mathrm{Re} = \frac{\rho U L}{\mu}$$

where ρ is the liquid density (kg/m$^3$), U is a characteristic velocity (m/s), L a characteristic length (m) and μ the liquid viscosity, (Pa·s), is sufficiently small that inertial effects are small and the flow is predominantly laminar in nature. The transition to turbulent flow in a straight pipe occurs at Re above approx 2000. Significant effort has been directed toward "lab-on-a-chip" microfluidic technology, in which researchers seek to carry out known chemical or biological reactions on a very small scale on a "chip", or microfluidic device. Additionally, new techniques not necessarily known on the macro-scale are being developed using microfluidics. Examples of techniques being developed at the microfluidic scale include high-throughput screening, drug delivery, chemical kinetics measurements, combinatorial chemistry as well as the study of fundamental questions in the fields of physics, chemistry and engineering.

The field of dispersions is well studied. A dispersion (or emulsion) is a mixture of two materials, typically fluids, defined by a mixture of at least two incompatible (immiscible) materials, one dispersed within the other. That is, one material is broken up into small, isolated regions, or droplets, surrounded by another phase (dispersant), within which the first phase is carried. Typically the dispersed material is stabilised with a surface active material, that is a small molecule or polymeric or particulate material that preferentially forms a layer at the interface between the two immiscible materials.

Droplets of one fluid in a second immiscible fluid are useful in a wide range of applications, particularly when the droplet size and the size distribution can be prescribed on a micro- or nanoscale. As examples, many personal care products, foods, and products for topical delivery of drugs are emulsions, and nanoemulsions have been proposed for decontamination of surfaces infected in some way, e.g., bacteria, bioterror agents, etc. For electrophotographic printing monodisperse toner droplets are used. Silver halide photographic systems provide the colorants in dispersed phases. Similar emulsion structures are considered for organizing liquid crystal droplets into optical devices. More recently significant research and development work has been focussed on the use of colloidal crystals, created from monodisperse particles, as building blocks for photonic systems.

Conventional methods for formation of emulsions are typically mechanical in nature, that is they use moving parts and so use shear to form the droplets. These techniques are not generally suitable for the formation of very small droplets. However, membrane emulsification is one small scale technique using micron scale pores to form emulsions. These methods whilst cheap typically produce polydisperse droplets unsuitable in size or size distribution for many applications. Further, although in many cases sophisticated, these methods do not allow precise and arbitrary mixtures to be included within the droplets formed.

Recently, microfluidic flow focussing droplet creation systems have been explored. However as a method of production, the devices currently used are limited in flow speed to Capillary and Reynolds numbers less than about 1 and 10 respectively and therefore to droplet formation rates below about 20 kHz.

There are a number of known methods and devices relating to the formation of droplets.

US 2006/0234051 describes a method to produce filaments or bubbles.

US 2007/0003442 describes many methods to control fluid droplets within a microfluidic system.

US 2007/0054119 describes methods to create particles from droplets within a microfluidic arrangement.

WO 1999/031019 describes a method to produce monodisperse bubbles within a liquid or liquid drop.

WO 2004/002627 describes a flow focussing system for creating droplets of dimension less than 20 μm.

WO 2005/103106 describes microfluidic methods for creating hardened particles.

WO 2006/096571 describes devices and methods to produce multiple emulsions, that is drops within drops.

U.S. Pat. No. 6,377,387 describes various methods for generating encapsulated dispersions of particles.

WO 02/23163 describes cross-flow devices for making emulsion droplets for bio applications.

PROBLEM TO BE SOLVED BY THE INVENTION

Currently, microfluidic methods to produce monodisperse droplets or particles are limited by the physics of the droplet production process to rates of about 20000 per sec. Whereas this is adequate for current applications where only very small quantities are required, it is too slow and therefore too expensive to be used as a method to create materials, i.e. monodisperse emulsions or particles dispersions, for applications requiring large quantities. The present invention enables monodisperse droplets to be formed at very high speed.

SUMMARY OF THE INVENTION

According to the present invention there is provided a method of creating substantially monodisperse droplets, comprising supplying a first fluid and a second immiscible fluid within a set of channels, the second fluid surrounding the first fluid and filling the channels to form a composite jet, the composite jet passing through an entrance channel into a wider cavity, where the first fluid breaks into droplets, the resulting composite of droplets of the first fluid within the second fluid passing through an exit channel, the cross sectional area of the exit channel perpendicular to the flow being smaller than the cross sectional area of the cavity and wherein the passage of a droplet of the first fluid out of the cavity via the exit perturbs the composite flow field within the cavity such that the incoming jet of the first fluid is perturbed.

The invention further provides a device for creating substantially monodisperse droplets comprising a set of channels, within which flow a first fluid and a second immiscible fluid surrounding the first fluid to form a composite jet, and an expansion cavity having an entrance channel and an exit channel, the cross sectional area of the cavity being larger than the cross sectional area of the entrance and exit channel, the composite flow breaking up within the cavity to form droplets of the first fluid within the second fluid, the passage of a droplet of the first fluid out of the cavity via the exit perturbing the composite flow field within the cavity such that the incoming jet of the first fluid is perturbed.

ADVANTAGEOUS EFFECT OF THE INVENTION

The method of the present invention enables the passive regularisation of random Rayleigh jet break up.

Further, the method, by regularisation of jet break up, allows microfluidic monodisperse droplet formation at significantly higher speed than current art.

Further, the method enables the manufacture of monodisperse droplets or particles at significantly higher speed than current art.

BRIEF DESCRIPTION OF THE DRAWINGS

The invention will now be described with reference to the accompanying drawings in which.

DETAILED DESCRIPTION OF THE INVENTION

Figure 1A:
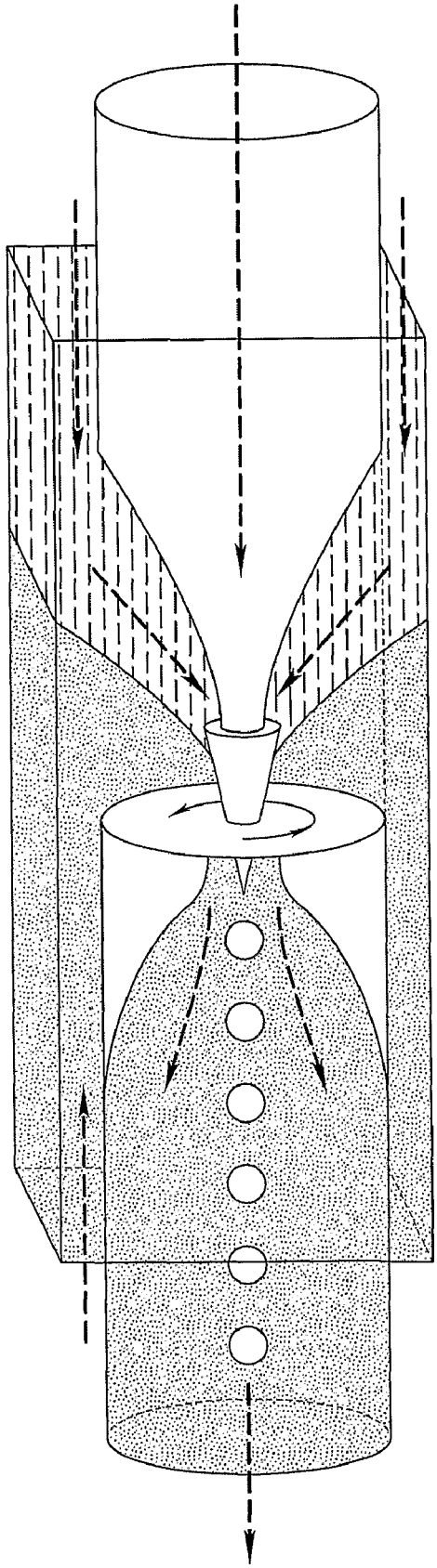
FIGS. 1*a* and 1*b* show devices from the prior art suitable for forming fluid jets in microfluidic devices.
Figure 1B:
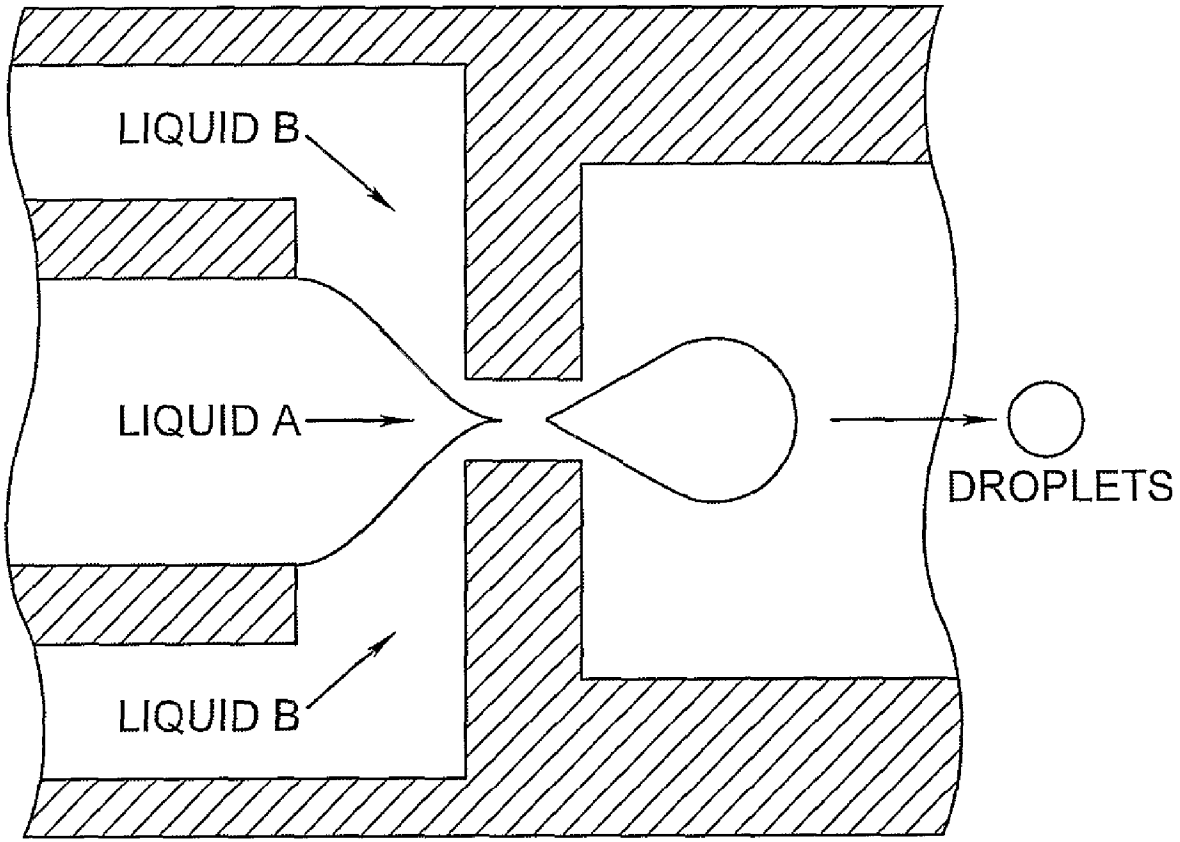

The ability to form a fluid jet of a first fluid within an immiscible second fluid within a microfluidic device is known in the art. Devices capable of this operation are shown in FIGS. 1*a* and 1*b*. However, the modes of operation usual for these devices are either a "geometry controlled" or a "dripping" mode, where monodisperse drops of the first fluid are directly formed. These modes are explained in S. L. Anna, H C. Mayer, *Phys. Fluids* 18, 121512 (2006). However, it is also well understood that as the fluid flow velocity increases the first fluid passes the orifice responsible for the "geometry controlled" or "dripping" modes and forms a jet in the area beyond. This jet then breaks up into droplets controlled predominantly by interfacial or surface tension. This jet break up mode is termed the Rayleigh-Plateau instability and produces polydisperse droplets of the first fluid.

It is a remarkable and hitherto unknown fact that the break up of a jet of a first fluid within an immiscible second fluid within a channel can be regularised by providing, after the jet is formed, an expansion of the channel, a cavity, and an exit orifice such that as the droplets of the first fluid that are formed from the jet pass through the exit orifice, they perturb the flow within the cavity. In order to achieve a significant flow perturbation, the droplet cross sectional area should be an appreciable fraction of the exit orifice cross sectional area perpendicular to the flow direction. In preference the droplet cross sectional area should be greater than approximately one third of the exit orifice cross sectional area perpendicular to the flow direction. The flow perturbation is conducted back to the entrance orifice, i.e, where the channel first expands, and therefore perturbs the jet as it enters the cavity. Since the jet is intrinsically unstable this will subsequently cause the jet to break in a position commensurate with the same disturbance as convected by the jet. The droplet so formed will then in turn provide a flow perturbation as it exits the cavity at the exit orifice. Thus there will be provided reinforcement of the intrinsic break-up of the jet. The frequency at which this reinforcement occurs will correspond, via the jet velocity within the cavity, to a particular wavelength. The flow feedback process means that the initial perturbation must have a fixed phase relation to the exit of a droplet of the first fluid and therefore the cavity will ensure a fixed frequency is chosen for a given set of flow conditions. The frequency chosen, f in Hz, will be approximately $$f = (n + \beta)\frac{U_j}{L}$$

where $U_j$ is the velocity of the jet of the first fluid (m/s), L is the length of the cavity (m), n is an integer and β is a number between 0 and 1 that takes account of end effects. This is quite analogous to the frequency selection within a laser cavity.

It will be appreciated that the wavelength will depend on the diameter of the jet of the first fluid. Further it will be appreciated that the length of jet required before break-up is observed is dependent on the interfacial tension between fluid 1 and fluid 2, the viscosities of fluid 1 and fluid 2 and the velocity of flow. Thus the break-up length and therefore length of the cavity is reduced by using a higher interfacial tension, a lower viscosity of fluid 1 or a slower flow velocity. It is further possible to modify the flow velocity within the cavity without changing the exit velocity by increasing the dimension of the cavity perpendicular to the flow.

FIG. 2 illustrates a generalised arrangement that will enable the method of this invention. In FIG. 2*a*, a jet of a first fluid, 1, surrounded by a second fluid 2, is passed into a broad channel or cavity 3, via an entrance constriction 4, the second fluid filling the volume of the cavity 3 around the jet. The cavity 3 has an exit orifice 6. It is useful to consider the linear equations of a jet in air;

$$L_B = \frac{U}{\alpha}\ln\left(\frac{R}{\xi_i}\right)$$

where $L_B$ is the break off length of the jet (m) of the first fluid measured from the entrance to the cavity, U is the fluid velocity (m/s), R is the jet radius (m), $\alpha$ is the growth rate ($s^{-1}$) for a frequency of interest (e.g. the Rayleigh frequency $f_R \sim U/(9.02\,R)$ [$f_R$ in Hz]) and $\xi_i$ is the size of the initial perturbation (m). The growth rate may be obtained from the following equation $$\alpha^2 + \frac{2\eta(kR)^2}{\rho R^2}\alpha - \frac{\sigma}{2\rho R^3}(1-(kR)^2)(kR)^2 = 0$$

where $\eta$ is the viscosity of the first fluid (Pa·s), $\sigma$ is the interfacial tension (N/m) and k is the wavevector ($m^{-1}$) ($k=2\pi f/U$). Thus the break off length $L_B$ may be estimated and compared with the cavity length, L. The flow velocity, surface tension and length of the cavity should be mutually arranged such that the jet of the first fluid 1 breaks within the cavity. In a preferred embodiment $\frac{1}{3}L<L_B<L$.

Figure 2A:
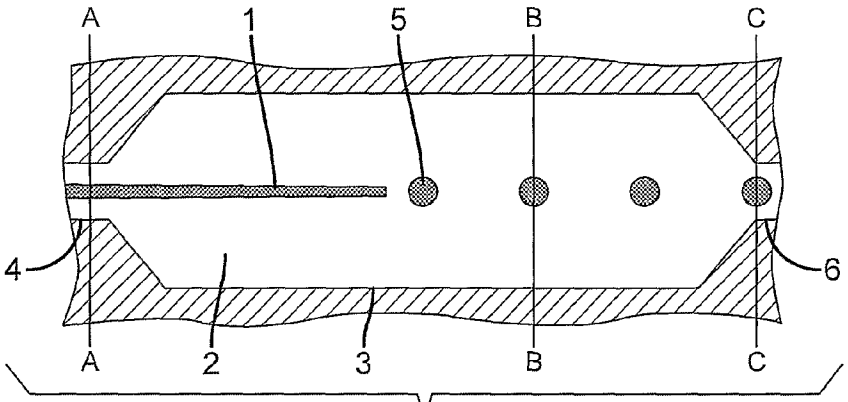
FIG. 2*a* illustrates a schematic side view of a general device suitable for performing the method of the invention.
Figure 2B:
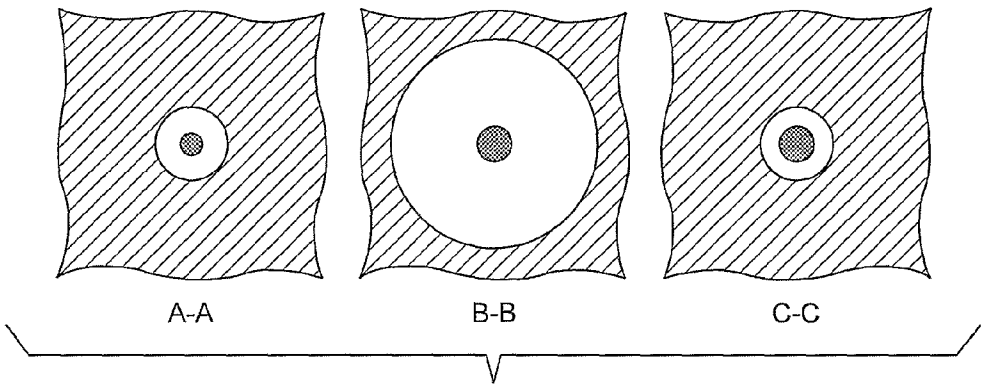
FIGS. 2*b*, 2*c* and 2*d* are cross sections of the device of FIG. 2*a;*
Figure 2C:
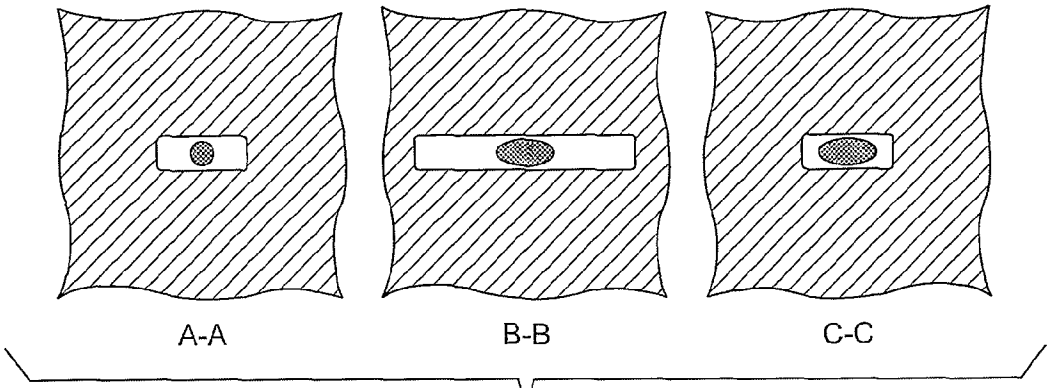
Figure 2D:
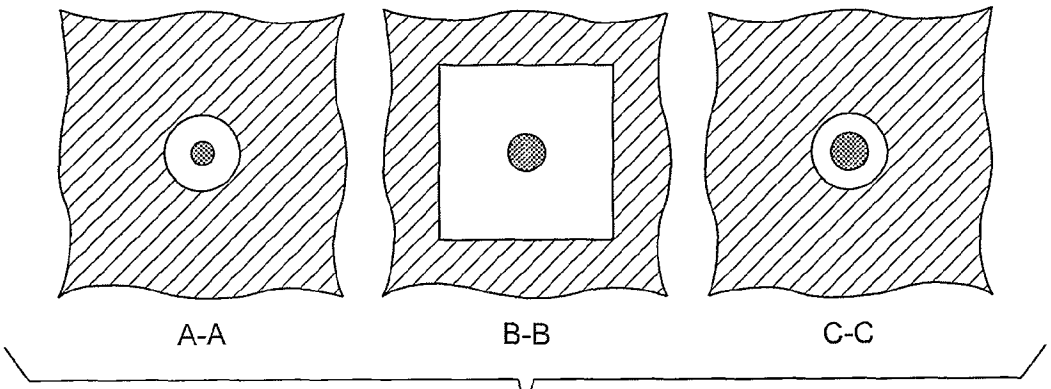

FIGS. 2*b*, 2*c* and 2*d* each illustrate a variation of the cross section of the entrance region A-A, the cavity, B-B, and the exit region C-C, which may be useful in practicing the invention. In FIG. 2*c* a flattened cross section is shown. Provided the droplet is large enough that it is flattened by the front and back surfaces of the channels, it will enhance the effect by creating a larger flow disturbance for a given droplet volume and exit cross section. The variations shown in FIGS. 2*b*, 2*c*, and 2*d* should not be taken as exhaustive and any general configuration consistent with the general requirements is permissible.

For some applications, particularly where the droplets of the first fluid are to be used by, or in, a subsequent process it may be advantageous to ensure a particular phase relation of the droplet formation to that subsequent process or relative to an external signal. In such circumstances a small perturbation may be applied to the fluid flow within the entrance region, the cavity region or the exit region. Such a perturbation may be conveniently applied by the use of a heater or a piezoelectric or an electrostatic device, or any other device that can perturb the fluid flow at the frequency of interest.

Figure 3A:
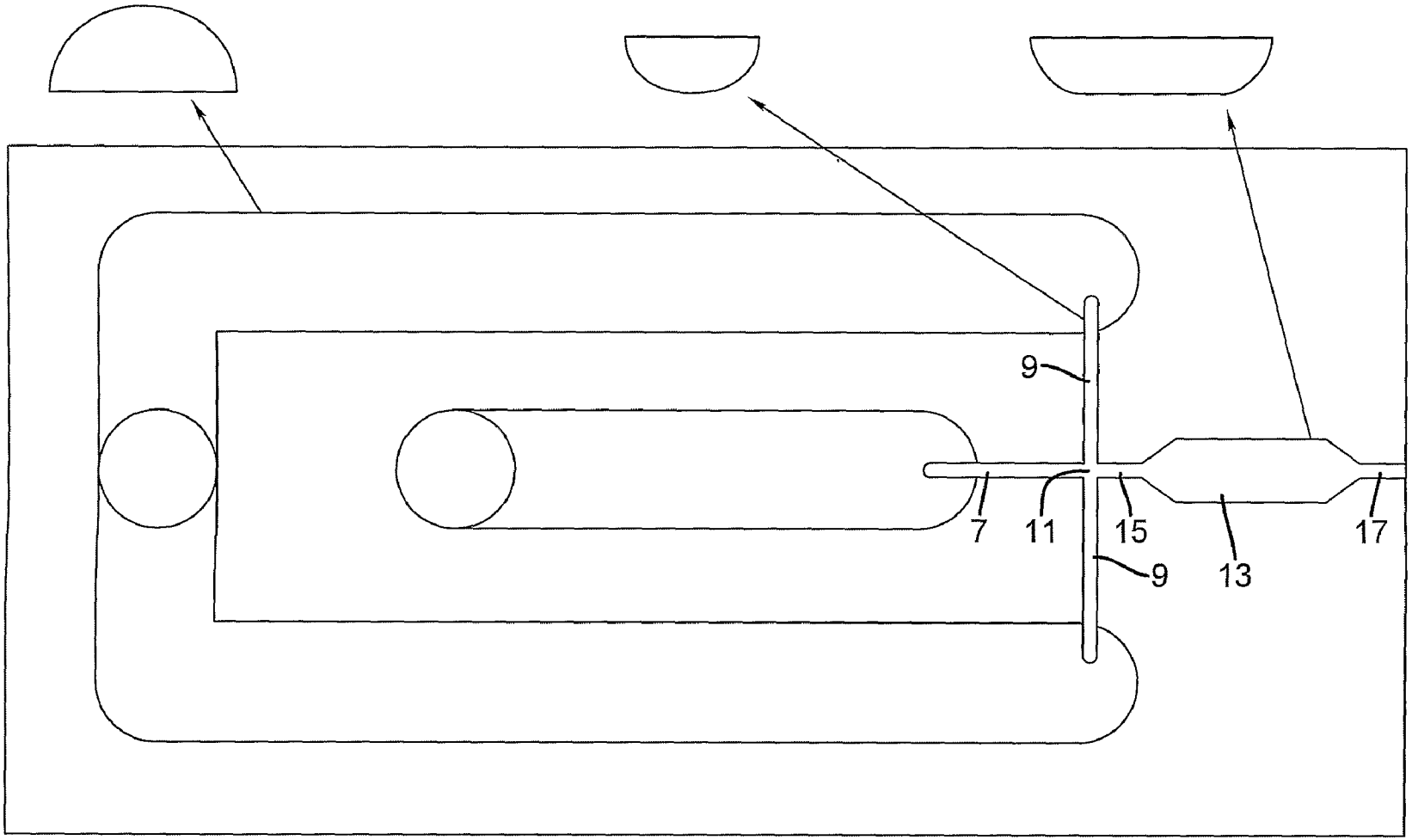
FIGS. 3*a* and 3*b* show schematic views of example devices shown to perform the invention.
Figure 3B:
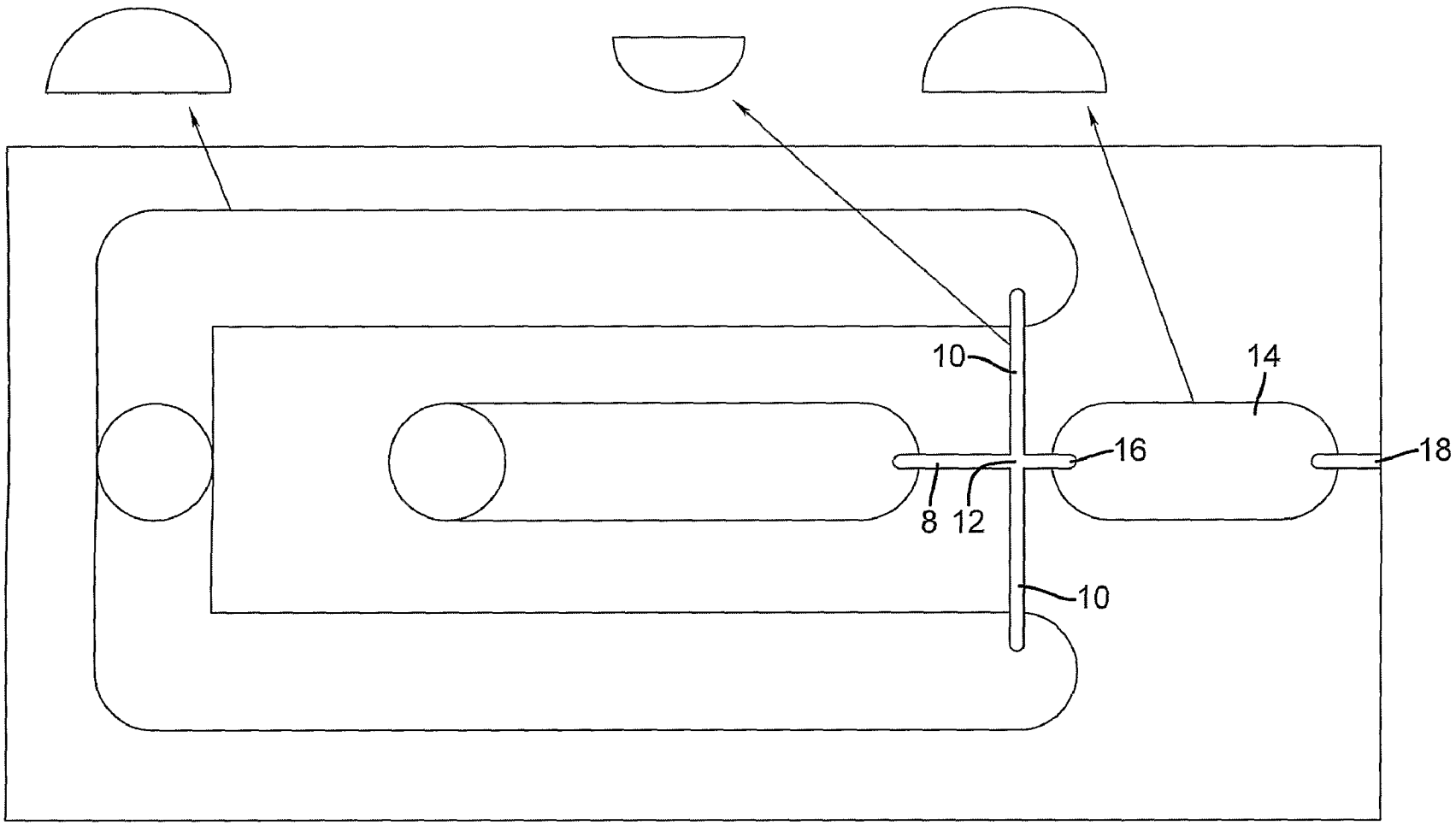

FIGS. 3*a* and 3*b* illustrate schematic layouts of devices shown to have performed the method of the invention. The material chosen to fabricate these devices was glass. It should be noted that the channel internal surfaces should be lyophilic with respect to the second fluid. Glass is hydrophilic. It will be understood by those skilled in the art that the invention is not limited to the use of glass channels. It will be understood by those skilled in the art that any suitable material may be used to fabricate the device, including, but not limited to, hard materials such as ceramic, silicon, an oxide, a nitride, a carbide or an alloy.

Each device comprises a central arm 7, 8 and upper and lower arms 9, 10. The upper and lower arms meet the central arm at a junction 11, 12. This part of the apparatus is a standard cross flow device. An expansion cavity 13, 14 is located immediately downstream of the junction 11, 12. The cavity 13, 14 has an entry nozzle 15, 16 and an exit nozzle 17, 18. The cross flow device is thus coupled via the cavity 13, 14 to the exit nozzle 17, 18. The cavity has a larger cross sectional area than the entry or exit nozzle.

The liquid supplied via the central arm is substantially immiscible with the liquid supplied via the upper and lower arms.

The devices shown were supplied with deionised water in both the upper and lower arms 9,10 at the same pressure. The water may contain a surfactant. Experiments with decane ($\rho$=0.73 g/cc, $\eta$=0.92 mPas), hexadecane ($\rho$=0.773 g/cc, $\eta$=3.34 mPas, $\sigma_{ow}$=53.3) and 1-octanol ($\rho$=0.824 g/cc, $\eta$=9.5 mPas) (interfacial tensions—Hirasaki G. J., *J. Adhesion Sci. Technol.*, 7, 285 (1993).) were conducted by supplying each in turn to the central arm 7,8. In each case, the oil may contain a colorant.

A liquid jet of a first fluid (decane, hexadecane or 1-octanol) was created within a second fluid, deionised water, at the junction 11,12. The jet formed a narrow thread that broke into droplets of the first fluid within deionised water in the broad region of the cavity 13,14. It was observed that over a particular pressure ratio, the jet aimed within the cavity 13,14 broke regularly into droplets. The droplets of fluid 1 so formed were expelled through the exit orifice 17,18 together with the deionised water and collected on a glass slide, such that a volume of deionised water containing monodisperse droplets of the first fluid was formed.

Figure 4B:
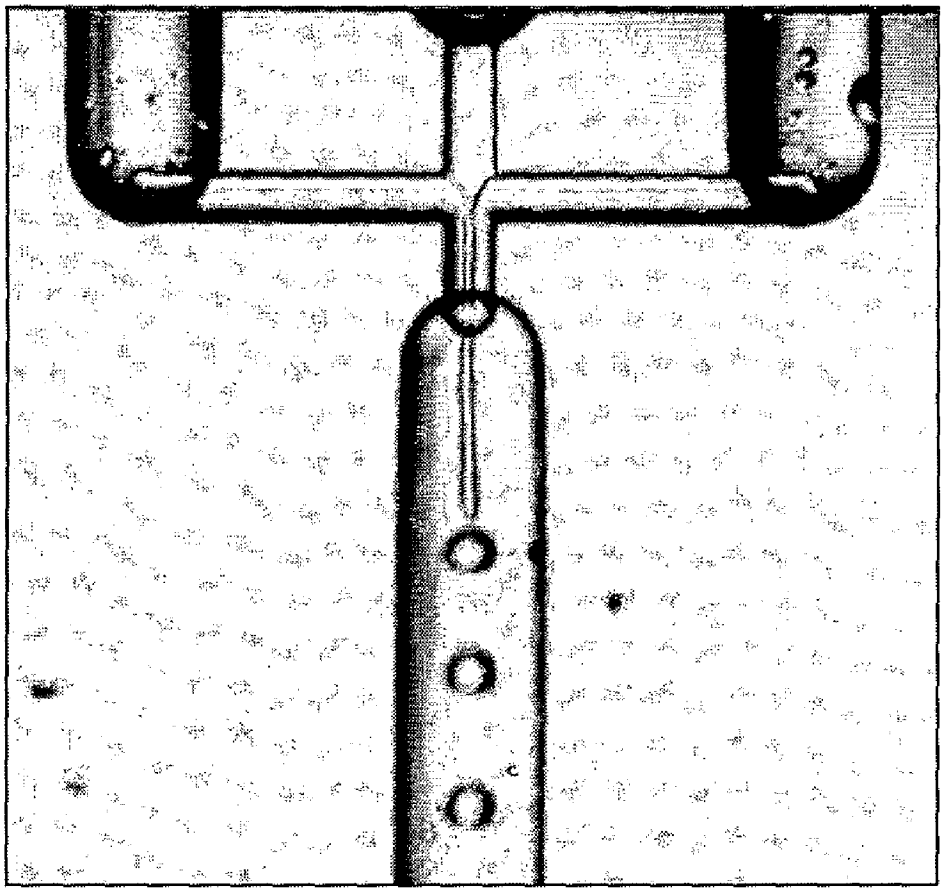
FIG. 4 is a copy of a photograph of the devices in FIG. 3 performing the invention.
Figure 4A:
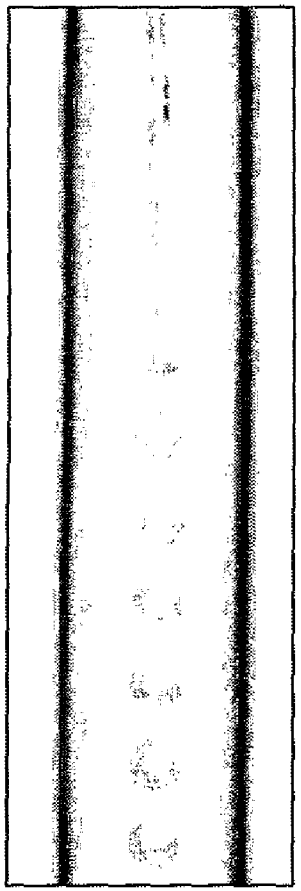

FIG. 4*a* illustrates the regular formation of droplets within the cavity of the device shown in FIG. 3*a*. FIG. 4*b* illustrates the regular formation of droplets within the cavity of the device shown in FIG. 3*b*. In each case the flow conditions equate to jet velocities in excess of 1 m/s.

Figure 5:
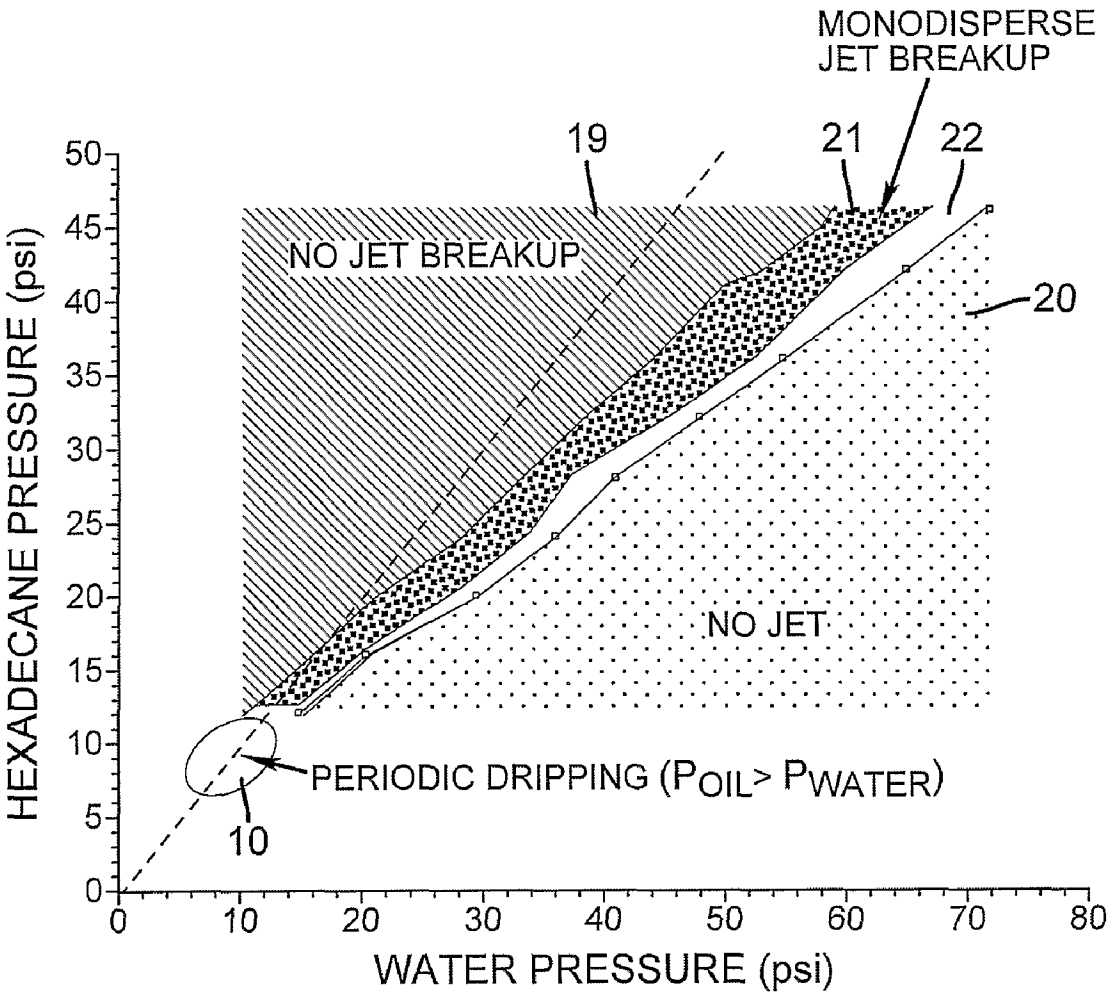
FIG. 5 is a control diagram for hexadecane and water supplied to the device of FIG. 3.

FIG. 5 illustrates a particular control diagram for the hexadecane/water system. The pressures shown are psi and are measured at the liquid supply vessel and therefore may vary slightly from those at the junction 11, 12. When the hexadecane pressure is high relative to the water pressure no jet break-up is observed (region 19) and the jet of hexadecane passes completely through the device. Conversely when the hexadecane pressure is too low relative to the water pressure, the hexadecane does not form a jet at the junction 11,12 (region 20). When the pressures are substantially similar, a jet of hexadecane is formed which breaks regularly (region 21). At slightly lower hexadecane pressures or slightly higher water pressures, the hexadecane jet is sufficiently thin that the droplets formed are not large enough to significantly perturb the pressure at the exit orifice and less regular break-up is observed (region 22).

Figure 6:
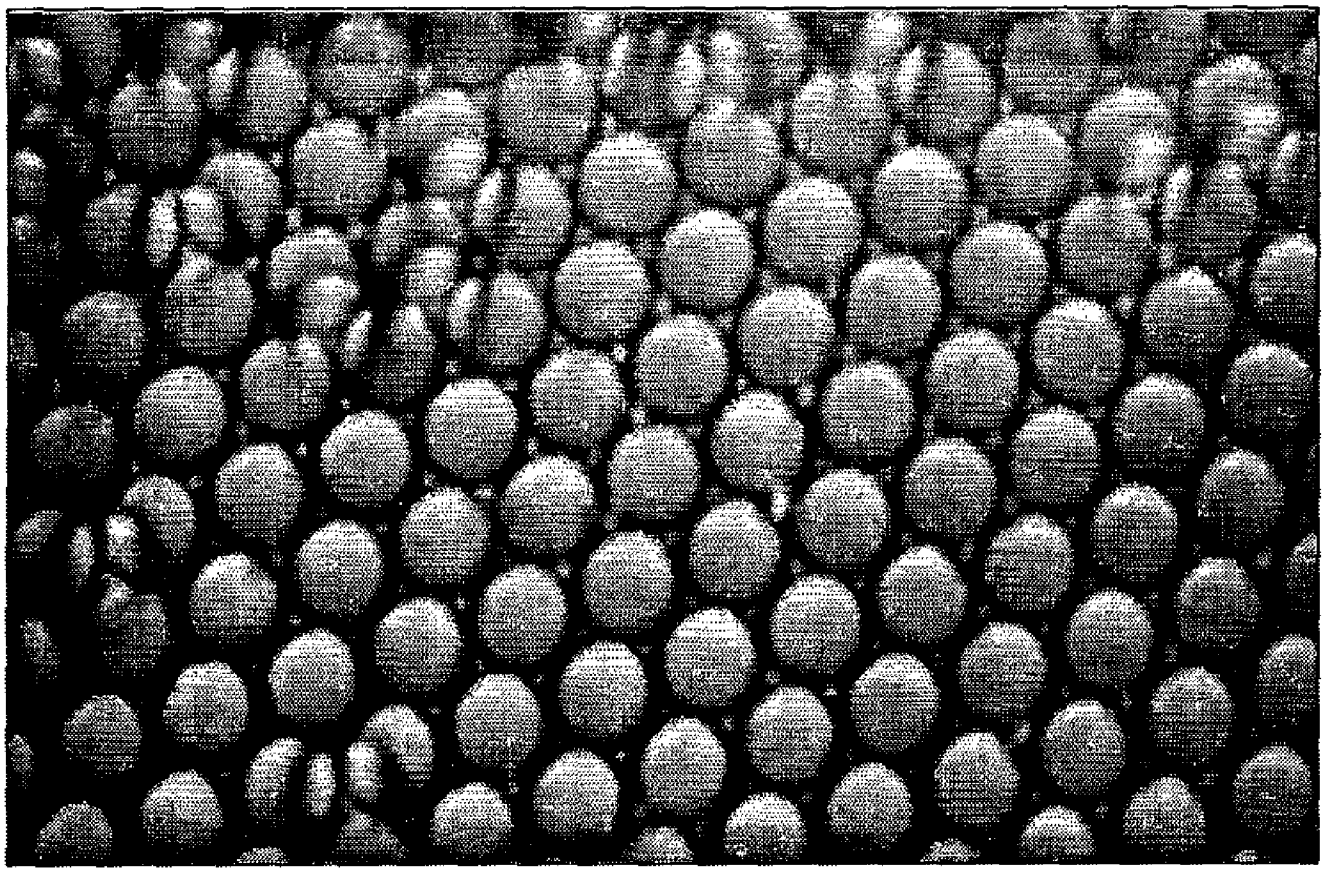
FIG. 6 is a copy of a photograph of decane droplets formed using the device.

FIG. 6 is a copy of a microscope photograph of the collected droplets in water, in this case decane in ionised water. The droplets are approximately 19 μm in diameter. This droplet formation was demonstrated at up to approximately 120 kHz and liquid exit velocities approximately 9 m/s.

Figure 7:
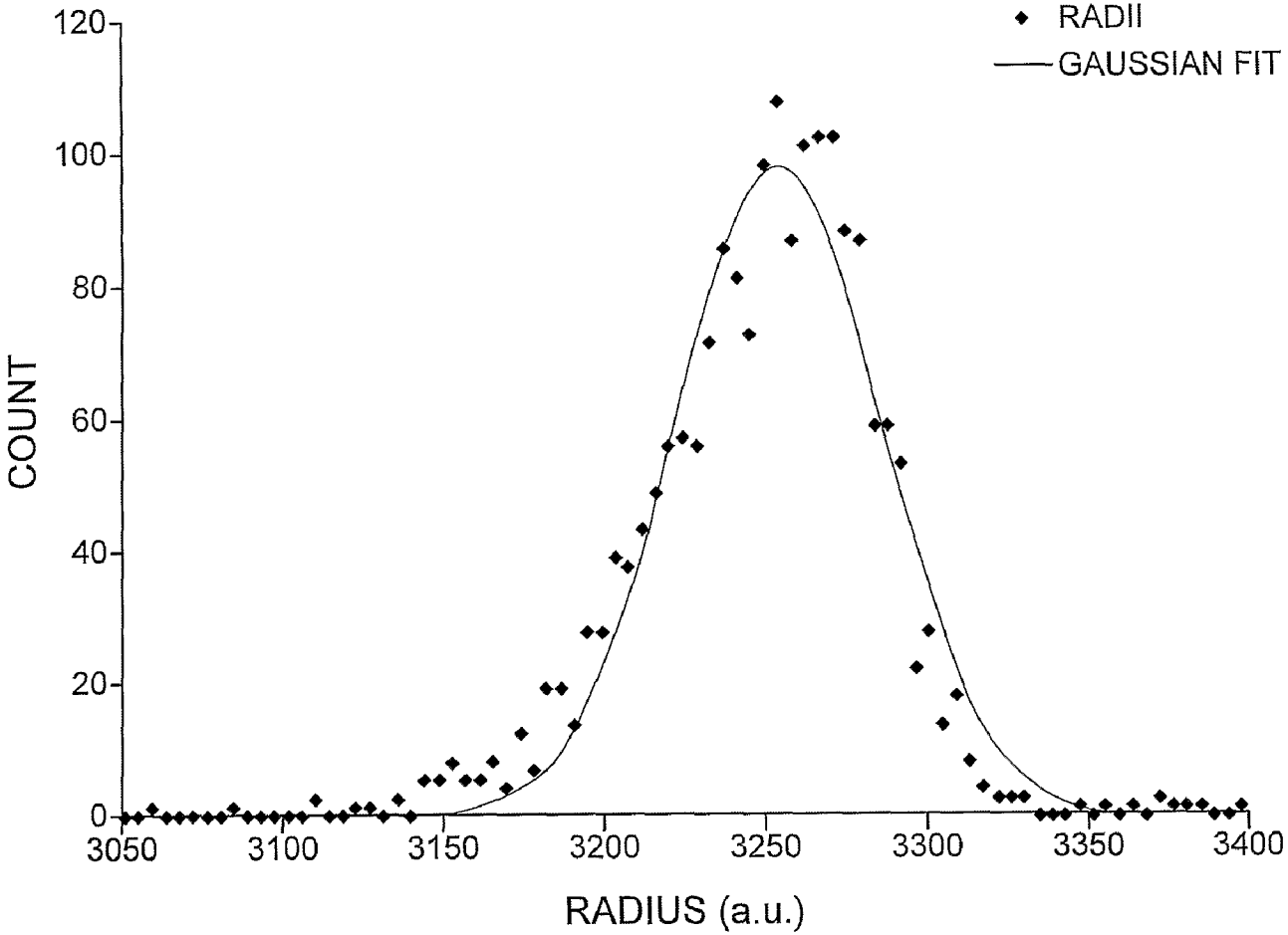
FIG. 7 illustrates a droplet size histogram measured when using the device of FIG. 3.

FIG. 7 shows a measurement of the polydispersity of the droplets as they are formed in the cavity. Decane was fed in the arm 7 at a pressure of approximately 27 psi and deionised water in the arms 9 at a pressure of approximately 37 psi. A video microscope was focussed on the cavity region 13 and images of droplets were captured stroboscopically and analysed for their radius by fitting a circle using LabVIEW software to each drop at a position ~2.5 wavelengths downstream from the breakoff point. The histogram of radius obtained was well fitted with a Gaussian function and thereby the dispersity (standard deviation of radius divided by mean radius) was found to be 0.9%.

Figure 8:
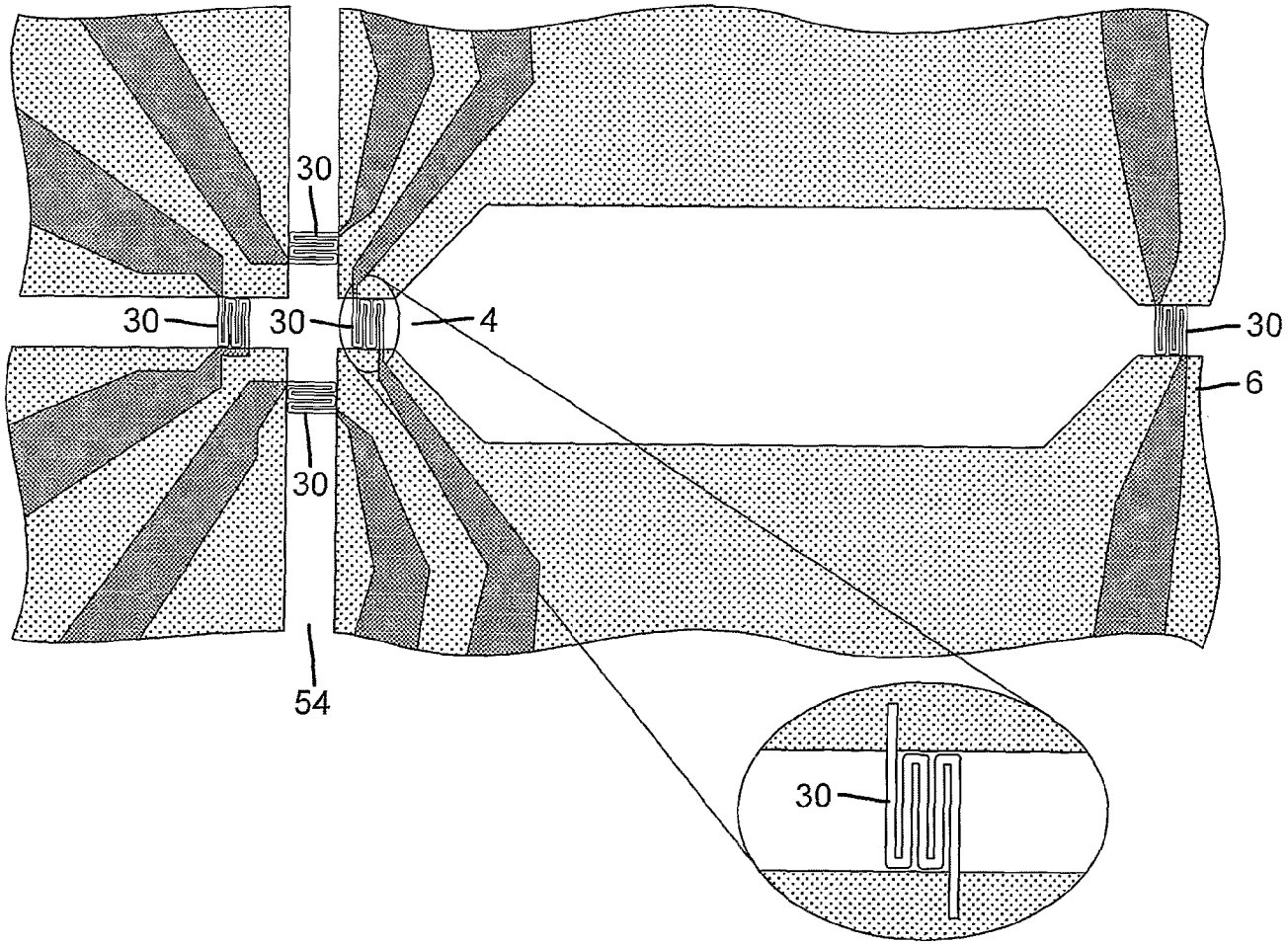
FIG. 8 is a schematic view of an example device with heaters to provide a particular phase relation.

FIG. 8 shows a schematic diagram of a device that cascades a flow focussing device to a cavity device as described in relation to FIG. 2, and includes a means to perturb the liquid flows. A 20 nm film of platinum and a 10 nm film of titanium were evaporated on one face of the glass capillary to form a zig-zag resistive heater pattern over each entrance constriction and the exit constriction, the film of titanium being next to the glass surface. The zig-zag pattern was a 2 micron wide track of overall length to give approximately 350 ohms resistance for the heater. The overall width was kept to a minimum to allow for the highest possible frequency of interaction with the flow. This width was approximately 18 microns. Each heater 30 could be energised independently. Whereas each heater had the desired effect, the heater over the cavity entrance constriction 4 was most efficient and was therefore used to collect the data shown in FIGS. 9 and 10.

Figure 9B:
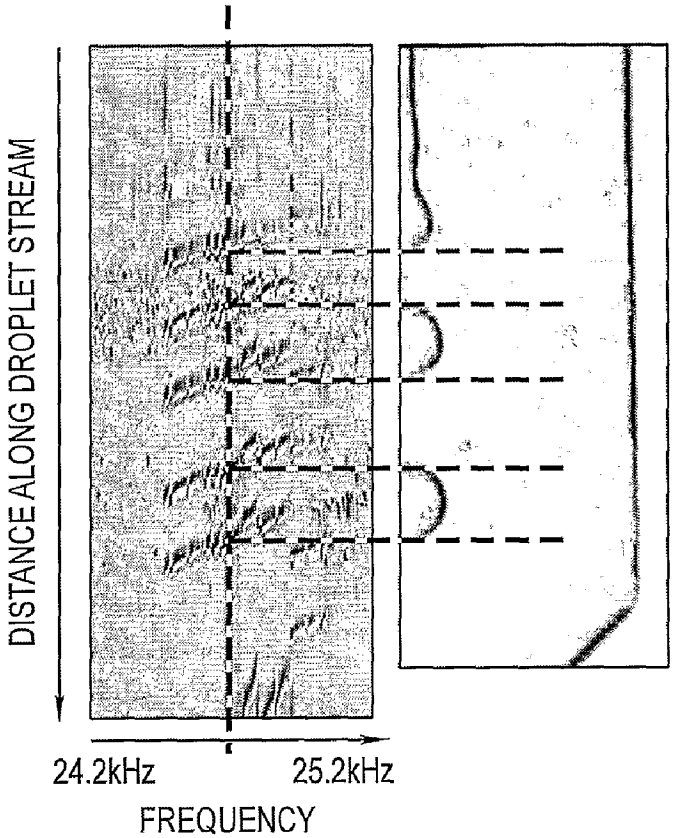
FIG. 9*a* is a copy of a photograph of drop formation with a heater perturbation active, 9*b* is an image compiled from a set of photographs as in FIG. 9*a;*
Figure 9A:
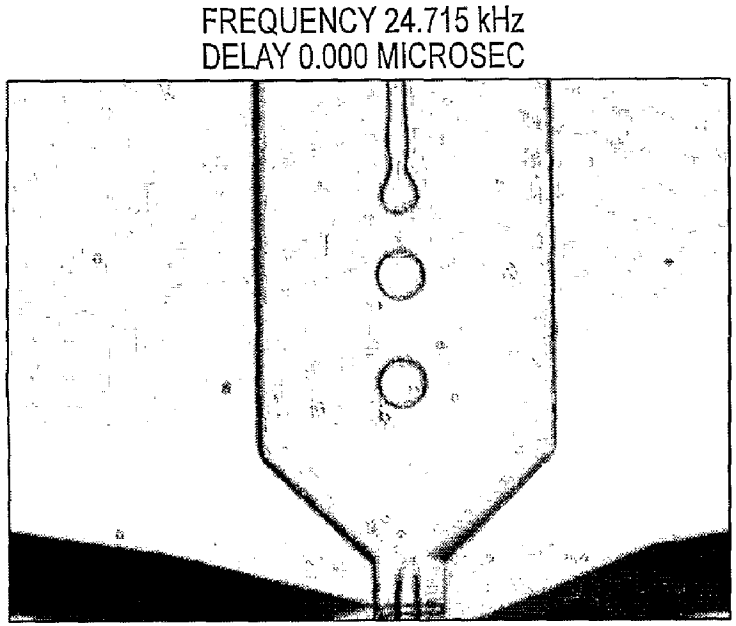

By pulsing the heater in phase with stroboscopic lighting it was possible to phase lock the internal drop breakup. The image is acquired using a standard frame transfer video camera running at 25 Hz, whereas the droplet formation is at around 25 kHz. A high brightness LED is used as the light source and flashes once for each droplet. Therefore each video frame is a multiple exposure of approximately 1000 pictures. If the droplets are synchronised with the light flashes then a single clear image is obtained, otherwise the multiple exposures lead to a blurred image with no distinct drops seen. The breakup phenomena could then be investigated as a function of the heater pulse frequency. FIG. 9*a* shows an image of internal drop breakup with the stroboscopic lighting phase locked with the heater pulse. The frequency was 24.715 kHz, the oil (drops) were decane and the external liquid was water. The decane was supplied at 41.1 psi and the water at 65.3 psi. The frequency was then varied from 24.2 kHz to 25.2 kHz in 5 Hz steps. For each image obtained the central line of pixels through the drops was extracted and used to form a column of pixels in a new image. The new image is shown in FIG. 9*b* where the y axis is distance along the channel centre and the x axis corresponds to frequency. The central region of the image in FIG. 9*b* show the existence of drops in phase with the strobe LED, whereas the left and right regions show no droplets, i.e. a blurred multiple exposure. Hence outside of a narrow band of frequencies the heater pulse was unable to phase lock the droplet formation This is a direct signature of resonant drop formation.

Figure 10:
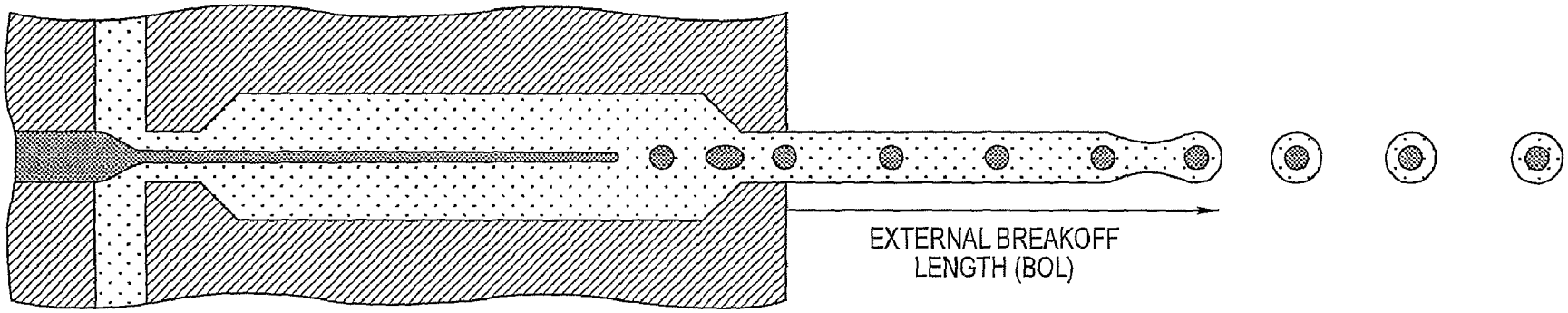
FIG. 10 illustrates the measure of external breakoff length.
Figure 11:
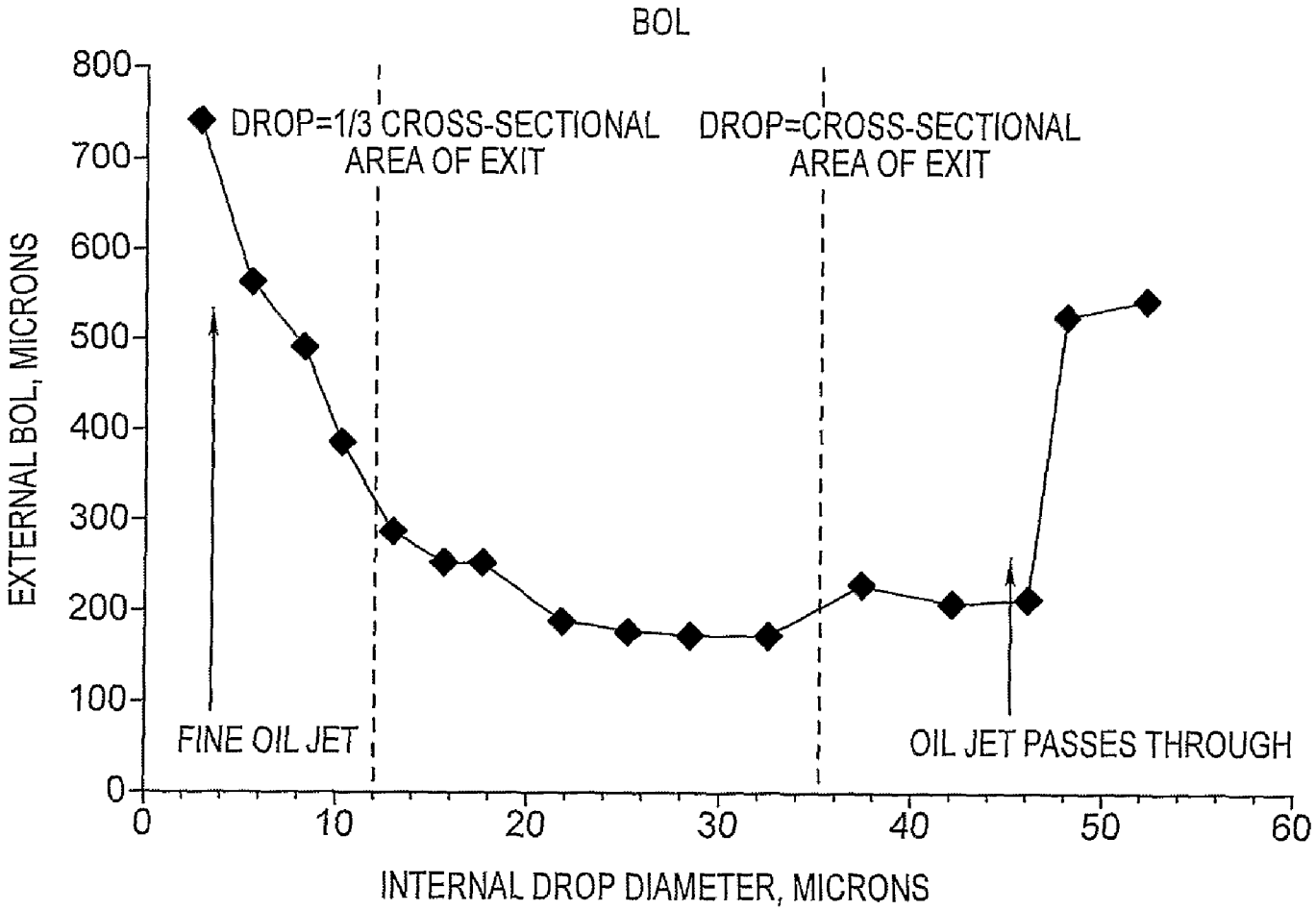
FIG. 11 is a graph illustrating the data of external breakoff length as a function of internal drop size.

A further set of example data demonstrates the dependence of the resonant behaviour on internal drop size. When each internal drop passes the exit orifice it creates a pressure pulse that perturbs the flow and leads to resonance. If the exit orifice also forms a jet, then the pressure pulse also perturbs the jet and thereby causes the jet to break prematurely. Hence the external jet breakoff length is a good measure of the strength of the pressure perturbation. The external breakoff length measure is illustrated in FIG. 10. The ratio of the oil and water supply pressure was varied, keeping the total flow rate approximately constant. The diameter of the internal drops was thereby varied. The diameter of the internal drop was optically measured together with the breakoff length. External breakoff length is plotted as a function of drop internal drop diameter in FIG. 11. Note that since the drops have a diameter greater than the channel height they are flattened and therefore the measured internal drop diameter is approximately proportional to the internal drop cross sectional area. FIG. 11 clearly indicates that the strong resonant behaviour occurs for internal drop cross-sections greater than about ⅓ of the exit orifice cross sectional area.

The invention has been described with reference to a composite stream of oil and an aqueous composition. It will be understood by those skilled in the art that the invention is not limited to such fluids. Furthermore, the invention is equally applicable to liquids containing surface active materials such as surfactants or dispersants or the like, polymers, monomers, reactive species, latexes, particulates. This should not be taken as an exhaustive list The invention has been described in detail with reference to preferred embodiments thereof. It will be understood by those skilled in the art that variations and modifications can be effected within the scope of the invention.

The invention claimed is:

1. A method of creating substantially monodisperse droplets, comprising supplying a first fluid and a second immiscible fluid within a set of channels, the second fluid surrounding the first fluid and filling the channels to form a composite jet, the composite jet passing through an entrance channel into a wider cavity, where the first fluid breaks into droplets, the resulting composite of droplets of the first fluid within the second fluid passing through an exit channel, a cross sectional area of the exit channel perpendicular to the flow being smaller than a cross sectional area of the cavity and wherein the passage of a droplet of the first fluid out of the cavity via the exit channel perturbs the composite flow field within the cavity such that an incoming jet of the first fluid is perturbed, wherein the first fluid breaks up into droplets at a distance approximately $L_B$ from the entrance channel of the cavity, the cavity being of length L and $L_B$ being greater than (⅓) L, and $L_B$ being less than L.

2. A method as claimed in claim 1 wherein the cross sectional area of the exit channel, perpendicular to the flow direction, is less than approximately three times the cross sectional area of the droplet.

3. A method as claimed in claim 1 wherein the composite jet flows through a cavity having a cross section perpendicular to the flow direction that is non circular.

4. A method as claimed in claim 3 wherein the composite jet flows through a cavity having a cross section perpendicular to the flow direction that is substantially rectangular or oval.

5. A method as claimed in claim 1 wherein the channels are provided with internal surfaces which are lyophilic with respect to said second fluid.

6. A method as claimed in claim 1 wherein the channels are fabricated from a hard material chosen from glass, ceramic, silicon, an oxide, a nitride, a carbide, an alloy.

7. A method as claimed in claim 1 wherein one fluid is a non-aqueous composition and the other fluid is an aqueous composition.

8. A method as claimed in claim 7 wherein the second fluid is an aqueous composition.

9. A method as claimed in claim 1 wherein a perturbation is applied to the flow entering the cavity or directly to the entrance flow or cavity flow or exit flow in order that the phase of the formation of the droplets of the first fluid is fixed with respect to the perturbation.

10. A device for creating substantially monodisperse droplets comprising a set of channels, within which flow a first fluid and a second immiscible fluid surrounding the first fluid to form a composite jet, and an expansion cavity having an entrance channel and an exit channel, a cross sectional area of the cavity being larger than a cross sectional area of the entrance and exit channel, the composite flow breaking up within the cavity to form droplets of the first fluid within the second fluid, the passage of a droplet of the first fluid out of the cavity via the exit channel perturbing the composite flow field within the cavity such that an incoming jet of the first fluid is perturbed, wherein the cavity has a length L, the jet breaking up at a distance approximately $L_B$ from the entrance channel, $L_B$ being greater than (⅓) L, and $L_B$ being less than L.

11. A device as claimed in claim 10 wherein the cross sectional area of the exit channel, perpendicular to the flow direction, is less than approximately three times the cross sectional area of the droplet.

12. A device as claimed in claim 10 further including means for collecting the manufactured composite of droplets of the first fluid within the second fluid, to allow further processing steps.

13. A device as claimed in claim 10 further including means to perturb the fluid flow within the entrance, cavity or exit regions and set the phase of the formation of droplets of the first fluid with respect to the perturbation.

14. A device as claimed in claim 13 wherein the perturbation means is a piezoelectric device.

15. A device as claimed in claim 13 wherein the perturbation means is an electrostatic device.

16. A device as claimed in claim 13 wherein the perturbation means is a heater.

17. A device as claimed in claim 10 wherein the channels are fabricated from a hard material.

18. A device as claimed in claim 17 wherein the channels are fabricated from a hard material chosen from glass, ceramic, silicon, an oxide, a nitride, a carbide, an alloy.

* * * * *